US009630055B2

(12) United States Patent
Runyan

(10) Patent No.: US 9,630,055 B2
(45) Date of Patent: Apr. 25, 2017

(54) VERSATILE GLUTE HAM SYSTEM

(71) Applicant: Robert Runyan, Bloomington, IL (US)

(72) Inventor: Robert Runyan, Bloomington, IL (US)

( * ) Notice: Subject to any disclaimer, the term of this patent is extended or adjusted under 35 U.S.C. 154(b) by 84 days.

(21) Appl. No.: 14/626,917

(22) Filed: Feb. 19, 2015

(65) Prior Publication Data

US 2015/0251037 A1 Sep. 10, 2015

Related U.S. Application Data

(60) Provisional application No. 61/948,005, filed on Mar. 4, 2014.

(51) Int. Cl.

| | |
|---|---|
| ***A63B 21/02*** | (2006.01) |
| ***A63B 21/04*** | (2006.01) |
| ***A63B 21/00*** | (2006.01) |
| ***A63B 23/035*** | (2006.01) |
| ***A63B 21/055*** | (2006.01) |

(Continued)

(52) U.S. Cl.

CPC ... *A63B 23/03508* (2013.01); *A63B 21/00047* (2013.01); *A63B 21/00072* (2013.01); *A63B 21/0442* (2013.01); *A63B 21/0552* (2013.01); *A63B 21/4034* (2015.10); *A63B 21/4035* (2015.10); *A63B 23/03525* (2013.01); *A63B 23/03533* (2013.01); *A63B 23/0482* (2013.01); *A63B 23/1236* (2013.01); *A63B 23/1263* (2013.01); *A63B 2208/0204* (2013.01); *A63B 2208/0209* (2013.01); *A63B 2225/09* (2013.01)

(58) Field of Classification Search

CPC ..... A63B 21/0421; A63B 21/0428; A63B 21/4047;A63B 2210/50; A63B 2225/09; A63B 21/00047; A63B 21/00072; A63B 21/0442; A63B 21/0552; A63B 21/4034; A63B 21/4035; A63B 23/035; A63B 23/03508; A63B 23/03525; A63B 23/03533; A63B 23/0355; A63B 23/03558; A63B 23/03566; A63B 23/0482; A63B 23/0488; A63B 23/1236; A63B 23/1263; A63B 2208/0204; A63B 2208/0209

See application file for complete search history.

(56) References Cited

U.S. PATENT DOCUMENTS 5,320,591 A * 6/1994 Harmon ..... A63B 23/00 482/121
5,567,202 A * 10/1996 Hager ..... A63B 23/0233 482/131

(Continued)

*Primary Examiner* — Joshua Lee
(74) *Attorney, Agent, or Firm* — Law Office of Robert M. Patino

(57) ABSTRACT

A versatile glute ham system for use with resistance bands is provided that is provided with a pivoting resistance arm assembly and a pivoting center pad assembly that are pivotally connected to a stabilization bar. The pivoting resistance arm assembly is provided with a resistance arm connection assembly and the pivoting center pad assembly is provided with a center pad connection assembly to secure the pivoting resistance arm assembly and the pivoting center pad assembly to a fixed position relative to the stabilization bar. The versatile glute ham system may optionally be provided with a plurality of connector points on the pivoting resistance arm assembly, the pivoting center pad assembly and the stabilization bar to receive resistance bands.

17 Claims, 7 Drawing Sheets

(51) Int. Cl.
*A63B 23/04* (2006.01)
*A63B 23/12* (2006.01)

(56) References Cited

U.S. PATENT DOCUMENTS

| | | | | | |
|---|---|---|---|---|---|
| 5,810,702 | A * | 9/1998 | Wilkinson | A63B 21/00047 | 482/130 |
| 6,468,188 | B1 * | 10/2002 | Koenig | A63B 21/0615 | 482/137 |
| 6,692,418 | B2 * | 2/2004 | Shahan | A63B 23/02 | 482/143 |
| 6,699,162 | B2 * | 3/2004 | Chen | A63B 21/4015 | 482/140 |
| 7,678,033 | B2 * | 3/2010 | Tyree | A63B 21/00072 | 482/129 |
| 8,029,423 | B2 * | 10/2011 | Thorpe | A63B 21/0023 | 482/133 |
| 8,172,736 | B2 * | 5/2012 | Contreras | A63B 21/00047 | 482/140 |
| 8,197,393 | B2 * | 6/2012 | Harmon | A63B 21/0023 | 482/121 |
| 9,119,984 | B2 * | 9/2015 | Littell | A63B 26/00 | |
| 2004/0209745 | A1 * | 10/2004 | Riney | A63B 21/0615 | 482/97 |
| 2010/0204027 | A1 * | 8/2010 | Dauterive | A61H 1/024 | 482/145 |
| 2013/0225378 | A1 * | 8/2013 | Burek | A63B 26/00 | 482/142 |

* cited by examiner

VERSATILE GLUTE HAM SYSTEM

BACKGROUND OF THE INVENTION

The present invention relates to a system that embodies a total body fitness machine, otherwise known as a versatile glute ham system, for the personal use either at home, at the office or at the gym that performs the general function as a glute ham machine but also allows for several additional exercises to enable the user to strengthen a vast array of muscle groups.

Home fitness machines are common place in the home or small office settings. Many are large, bulky and expensive. A typical home fitness machine that leverages weights and pulleys such as the Powerline Home Gym has a limited range of uses, is difficult to assemble and can be very heavy. Other home fitness machines such as the Soloflex or Bowflex home gyms leverage a plurality weight straps to increase or decrease resistance to the user. These machines take up a lot of space, are not collapsible and are difficult to transport.

A smaller piece of fitness equipment that is frequently found in work out centers is a machine called the glute ham machine (referred to as the traditional glute ham machine). The traditional glute ham machine is compact, but very one dimensional. Just as the name suggests, the traditional glute ham machine is designed to work the gluteus maximus (or butt), hamstrings and general core muscle groups. However, the traditional glute ham machine does not adjust its resistance arm and its center pad in an angular motion and thus, limits the potential of the traditional glute ham machine. This limitation restricts the user to perform only one exercise on the machine which requires home and small office users to purchase additional work out equipment to work other muscle groups. Moreover, the lack of an angular motion of a resistance arm and a center pad for adjustment restricts the ability to enhance the workout routine by limiting the resistance required to do various exercises. Furthermore, the lack of an angular motion for adjustment of the resistance arm and the center pad inhibits the traditional glute ham machine to be stored easily if desired by the user so that space on the floor can remain free for other uses when the traditional glute ham machine is not being used.

Additional potential is lost with the traditional glute ham machine because it lacks innovative additions that can make the traditional glute ham machine multi-dimensional. The traditional glute ham machine does not employ connector points to allow for the connection of rubber resistance tubes with grips, connection handles, a straight bar, triceps rope, a jump belt, and foot harnesses (referred hereinafter as rubber tubes with grips) so that upper and lower body muscles can be strengthened such as the biceps, triceps, back and shoulder muscles. Furthermore, the ankle pads on the resistance arms extend the length of the resistance arms preventing the use of the resistance arms for additional exercises such as push-ups. The lack of these innovative additions prevents the traditional glute ham machine from being widely adopted for home or small office use because a full body work out cannot be achieved.

Thus, there is a need for a versatile glute ham system that is versatile to allow for multiple types of exercises beyond the exercises enabled by the traditional glute ham machine that works primarily the gluteus maximus and hamstrings muscles. There is also a need for a versatile glute ham system that is capable of adjusting for storage and resistance purposes. Furthermore, there is a need for a versatile glute ham system that is provided with innovative additions that can accommodate rubber tubes with grips, resistance bands, or allow for push-ups to enhance the work out experience with the versatile glute ham system.

BRIEF SUMMARY OF THE INVENTION

The above-identified needs are addressed by the present versatile glute ham system. One feature of the present invention is a pivoting resistance arm assembly and a pivoting center pad assembly connected to a stabilization bar. The pivoting center pad assembly and the pivoting resistance arm assembly are provided with a center pad connection assembly and a resistance arm connection assembly to secure the pivoting resistance arm assembly and the pivoting center pad assembly a fixed position relative to a stabilization bar. Furthermore, the versatile glute ham system is provided with a plurality of connector aperture to accommodate rubber tubes with grips. The versatile glute ham system is optionally provided with a pair of push-up handles to allow the user to perform push-ups on the versatile glute ham assembly.

BRIEF DESCRIPTION OF THE DRAWINGS

FIG. 11 illustrates the use of the versatile glute ham system where a plurality of push-up handle connectors are employed to receive rubber tubes with grips.

FIG. 12 illustrates the use of the versatile glute ham system where connector points are provided on a mid-section of the pivoting resistance arm assembly to allow for a series of exercises at a user preferred height. One example of exercises may be arm extension with the use of rubber tubes with grips.

FIG. 13 illustrates the use of the versatile glute ham system where connector points are provided on a lower-section of the pivoting resistance arm assembly to allow for a series of exercises at a user preferred height. One example of exercises may be the extension of the legs with resistance bands.

DETAILED DESCRIPTION OF THE INVENTION

Figure 1:
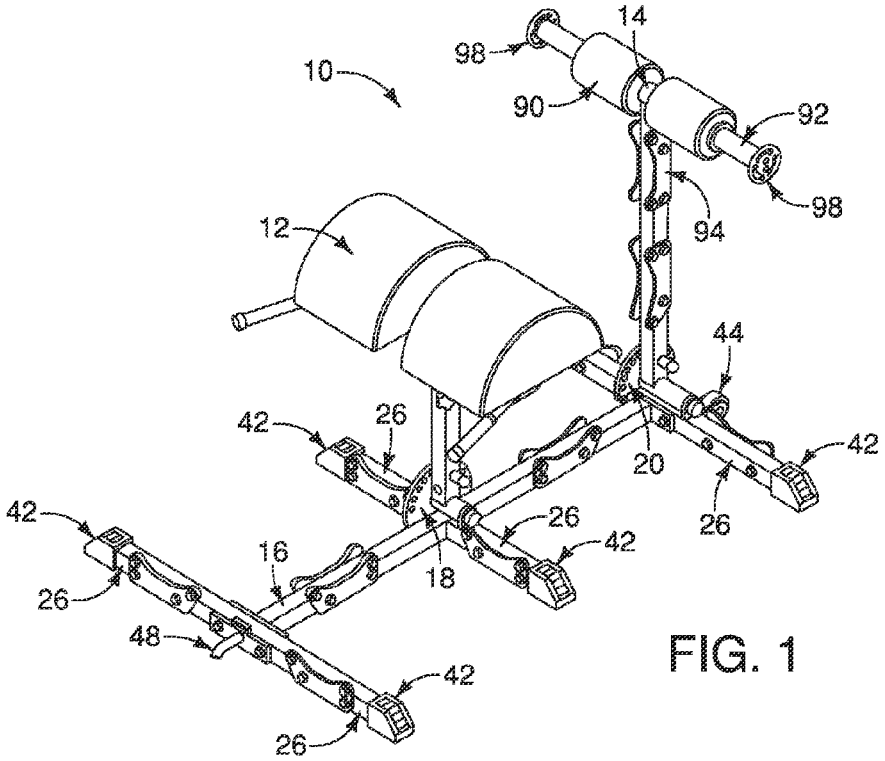
FIG. 1 is a front perspective view of a versatile glute ham system with a pivoting center pad assembly in a down position.
Figure 3:
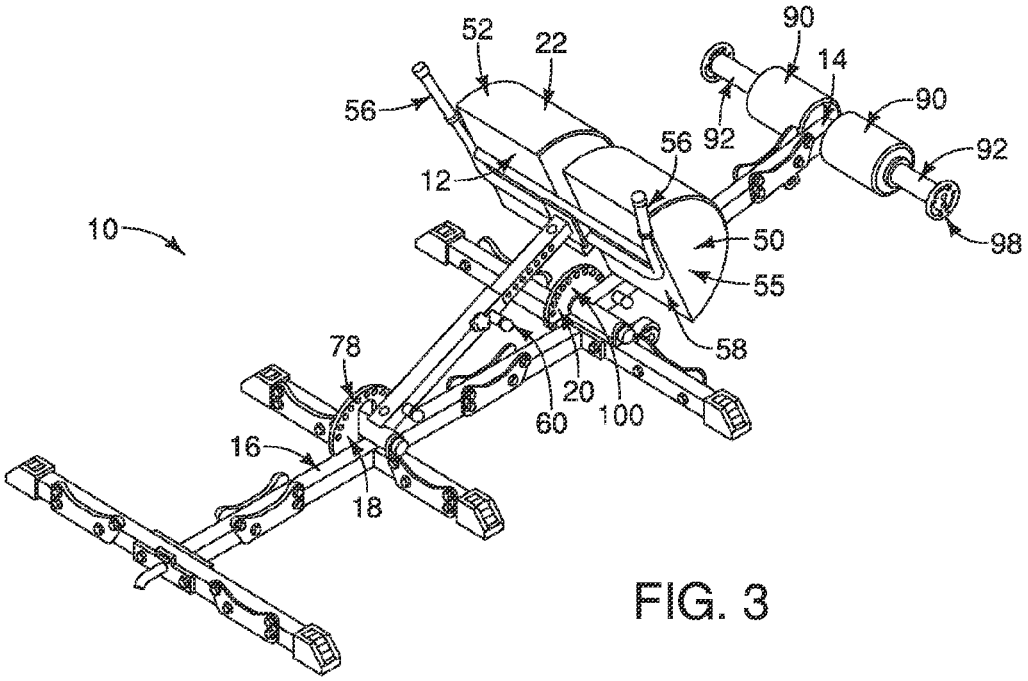
FIG. 3 is a front perspective view of the versatile glute ham system with the pivoting center pad assembly and a pivoting resistance arm assembly in a back position.
Figure 4:
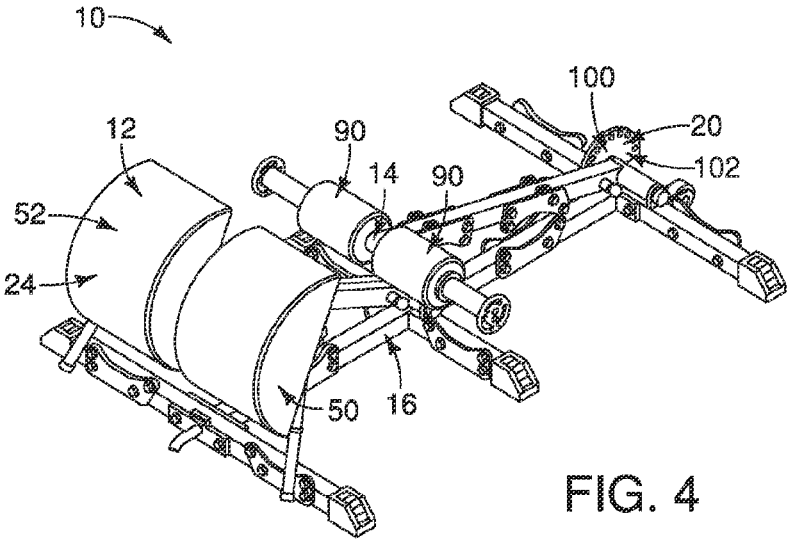
FIG. 4 is a front perspective view of the versatile glute ham system with the pivoting center pad assembly and the pivoting resistance arm assembly in a forward position.
Figure 9:
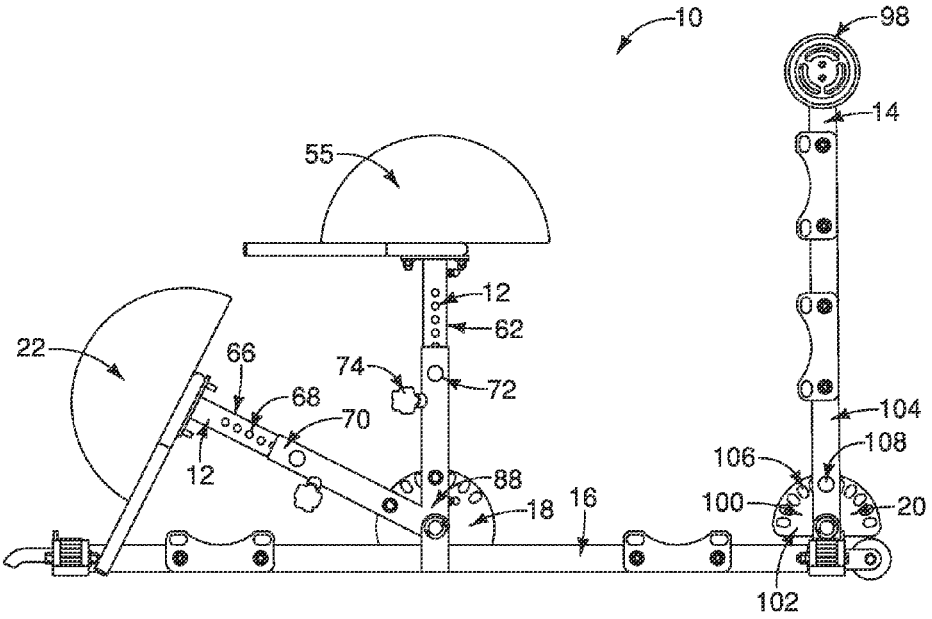
FIG. 9 is a right side planar view of the optional embodiment of the versatile glute ham system where a pivoting center pad assembly is moved from an upright, nearly 90 degree position to a forward position that approaches a 180 degree angle relative to a stabilization bar. The center pad is shown in an up position.
Figure 10:
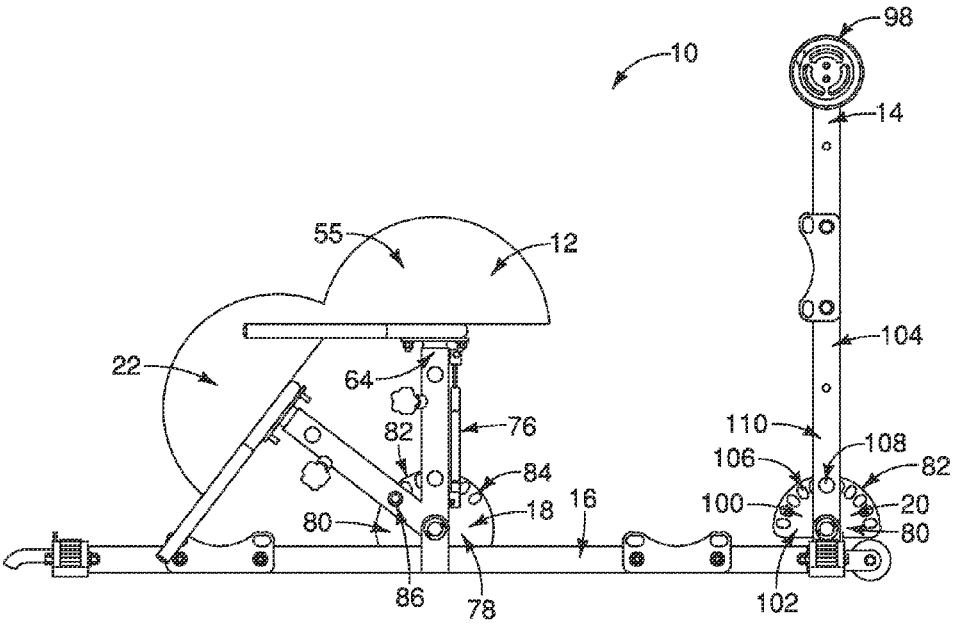
FIG. 10 is a right side planar view of the optional embodiment of the versatile glute ham system where the pivoting center pad assembly is moved from an upright, nearly 90 degree position to the forward position that approaches a 180 degree angle relative to the stabilization bar. The center pad is shown in a down position.

Referring now to FIG. 1, a versatile glute ham system 10 for use on a ground surface is provided with a pivoting center pad assembly 12 and a pivoting resistance arm assembly 14 that are portrayed in a standard position and both are connected to a stabilization bar 16. The pivoting center pad assembly 12 and the pivoting resistance arm assembly 14 are designed to pivot 180 degrees relative to the stabilization bar 16 by the means of a center pad connection assembly 18 and a resistance arm connection assembly 20. The movement from a back position 22 as illustrated in FIG. 3 to a forward position 24 as illustrated by FIGS. 4, 9 and 10 will be discussed in greater detail later in this Detailed Description.

Figure 2:
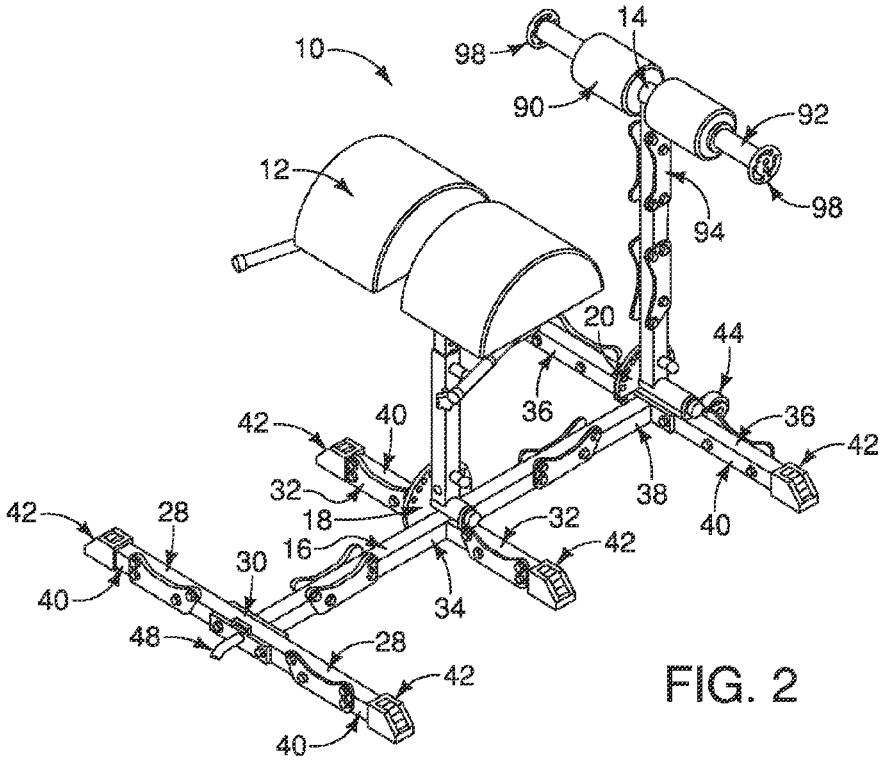
FIG. 2 is a front perspective view of the versatile glute ham system with the pivoting center pad assembly in an up position.
Figure 5:
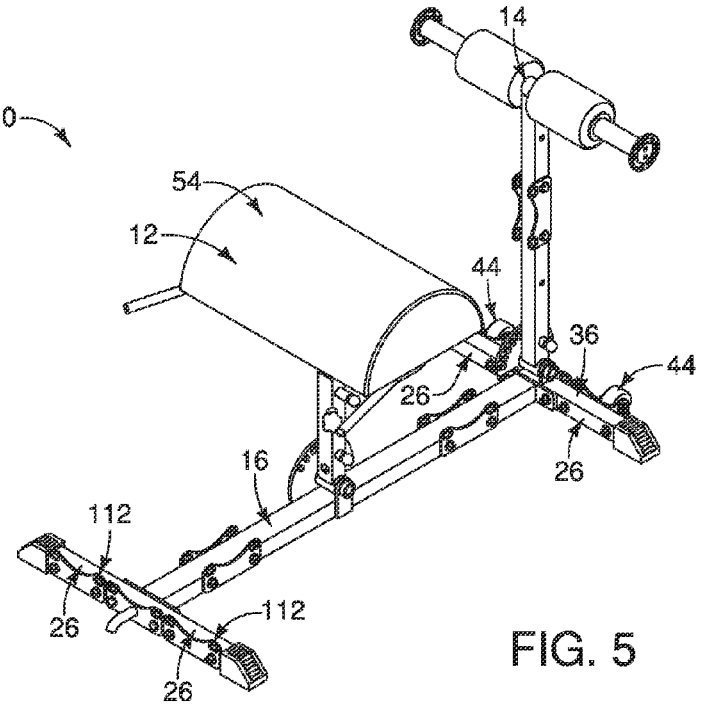
FIG. 5 is a front perspective view of an optional embodiment of the versatile glute ham system with one solid center pad illustrated and where a middle set of stabilization arms are removed.

In the embodiments shown in FIGS. 1, 2 and 5, the versatile glute ham system 10 also has a plurality of stabilization arms 26 connected to the stabilization bar 16. In the most preferred embodiment as shown in FIG. 5, two sets of stabilization arms 26 are employed and extended perpendicularly and planarly from the stabilization bar 16. As shown in FIG. 2, a front set of stabilization arms 28 are found at a front end 30 of the stabilization bar 16. In an optional embodiment, a middle set of stabilization arms 32 are found at a middle section 34 of the stabilization bar 16. In this embodiment, the middle set of stabilization arms 32 is preferably located just underneath the pivoting center pad assembly 12 and may be shorter in length than the front set of stabilization arms 28. A rear set of stabilization arms 36 are found at a rear end 38 of the stabilization bar 16. In the most preferred embodiment, the rear set of stabilization arms 36 are located just underneath the pivoting resistance arm assembly 14. The rear set of stabilization arms 36 may extend further out than the middle set of stabilization arms 32 to provide more stability. At an outward point of each stabilization arm 26, a stabilization foot 42 is attached. The stabilization foot 42 may be comprised of different types of felt, plastic, rubber or adhesive foot, but in the preferred embodiment, a rubber grip is employed. The rubber grip is sloped at an angle to minimize the sharpness that a right angled surface would produce and minimize the impact if someone were to fall on the stabilization foot 42. The stabilization foot 42 grips to the ground surface to prevent sliding of the versatile glute ham system 10 and to add stability when the user is working out on the versatile glute ham system 10.

Figure 6:
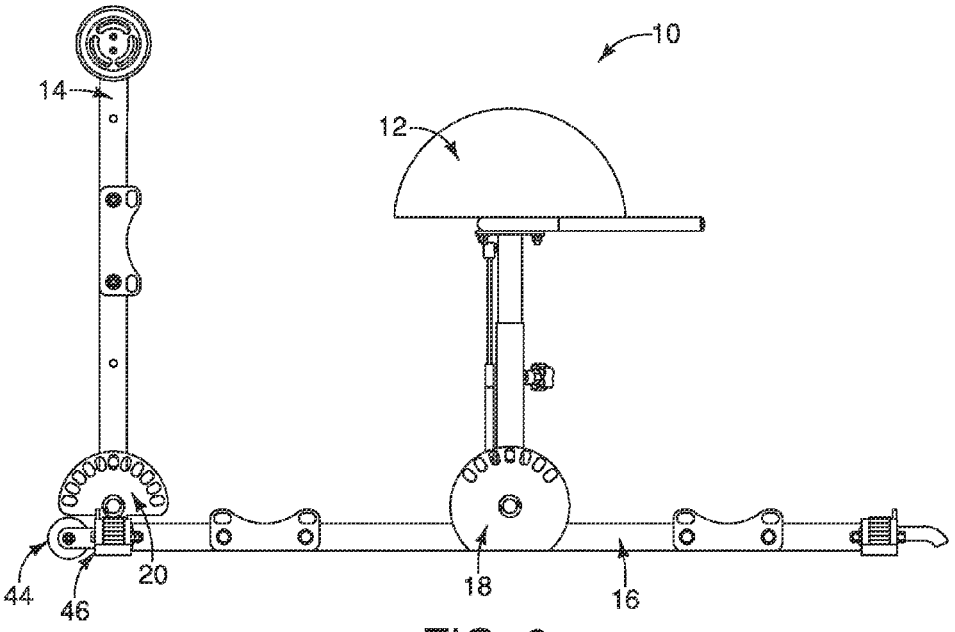
FIG. 6 is a left side planar view of the optional embodiment of the versatile glute ham system.
Figure 7:
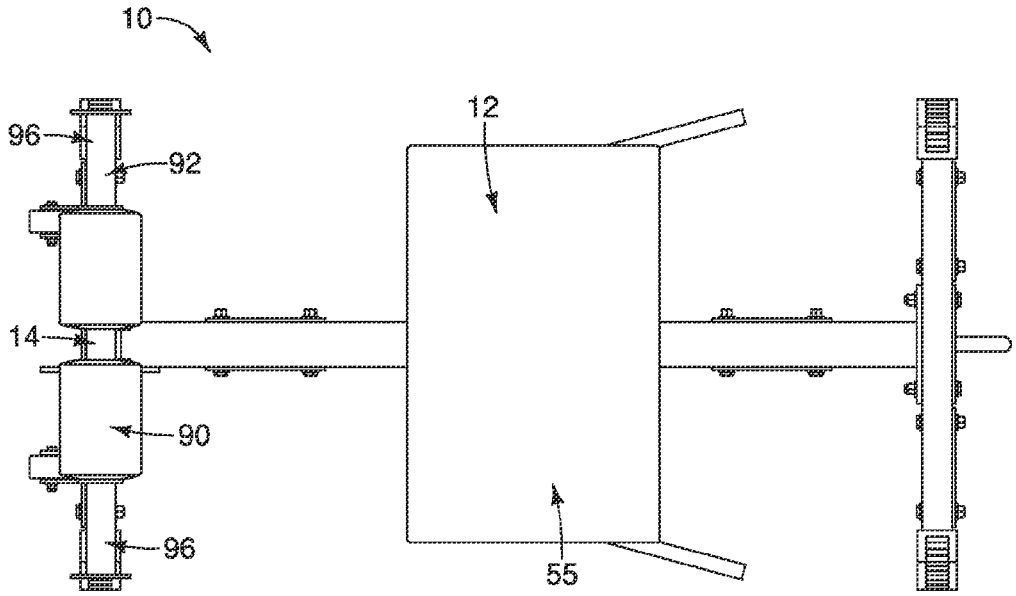
FIG. 7 is a top side planar view of the optional embodiment of the versatile glute ham system.
Figure 8:
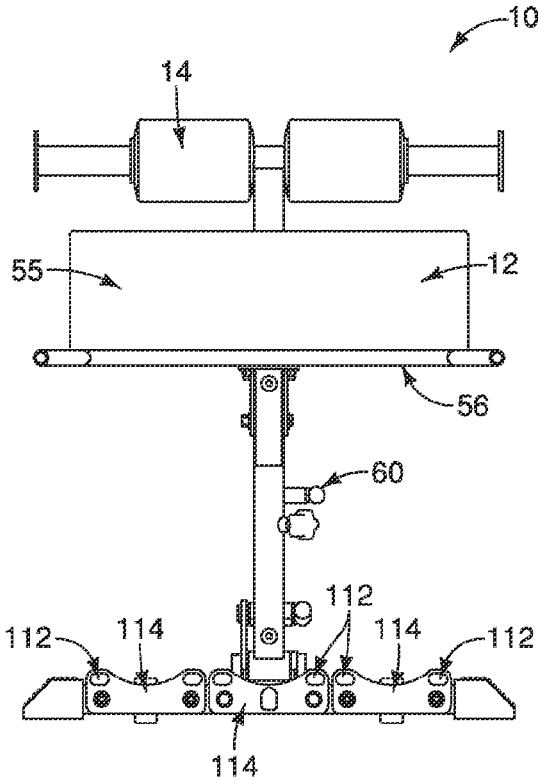
FIG. 8 is a front side planar view of the optional embodiment of the versatile glute ham system.

Optionally, referring to FIGS. 1, 5 and 6, a set of roller wheels 44 may be attached to the rear set of stabilization arms 36 at a rear side 46 of the rear set of stabilization arms 36. The set of roller wheels 44 allows the user to tilt the versatile glute ham system 10 at an angle and push or pull the versatile glute ham system 10 on the set of roller wheels 44 to a different location. Without the set of roller wheels 44, the versatile glute ham system 10 would need to be picked up or pushed along across a floor surface. This might cause the floor surface to become scratched or cause an injury to the user while carrying the versatile glute ham system 10.

Figure 11:
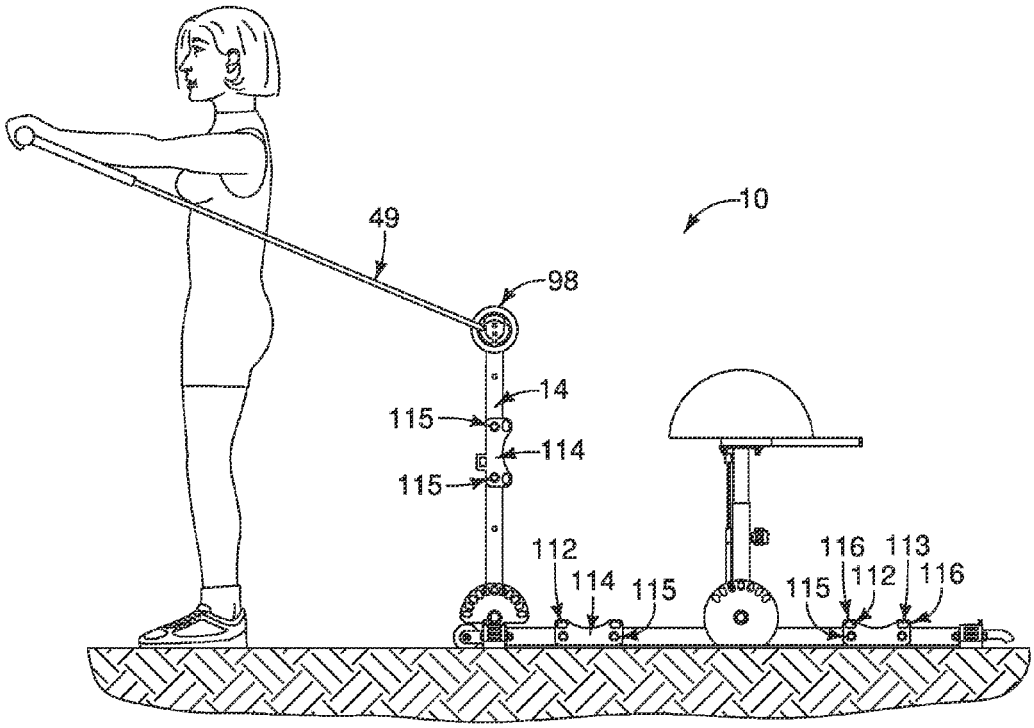
FIG. 11 is a left side planar view of the option embodiment of the versatile glute ham system in use.
Figure 12:
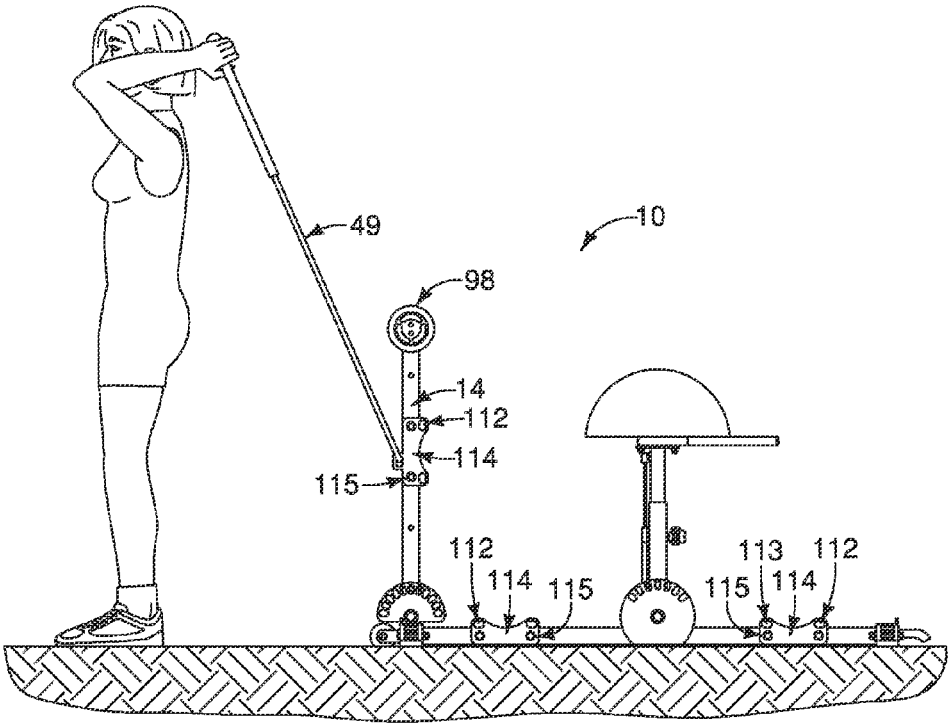
FIG. 12 is a left side planar view of the option embodiment of the versatile glute ham system in use.
Figure 13:
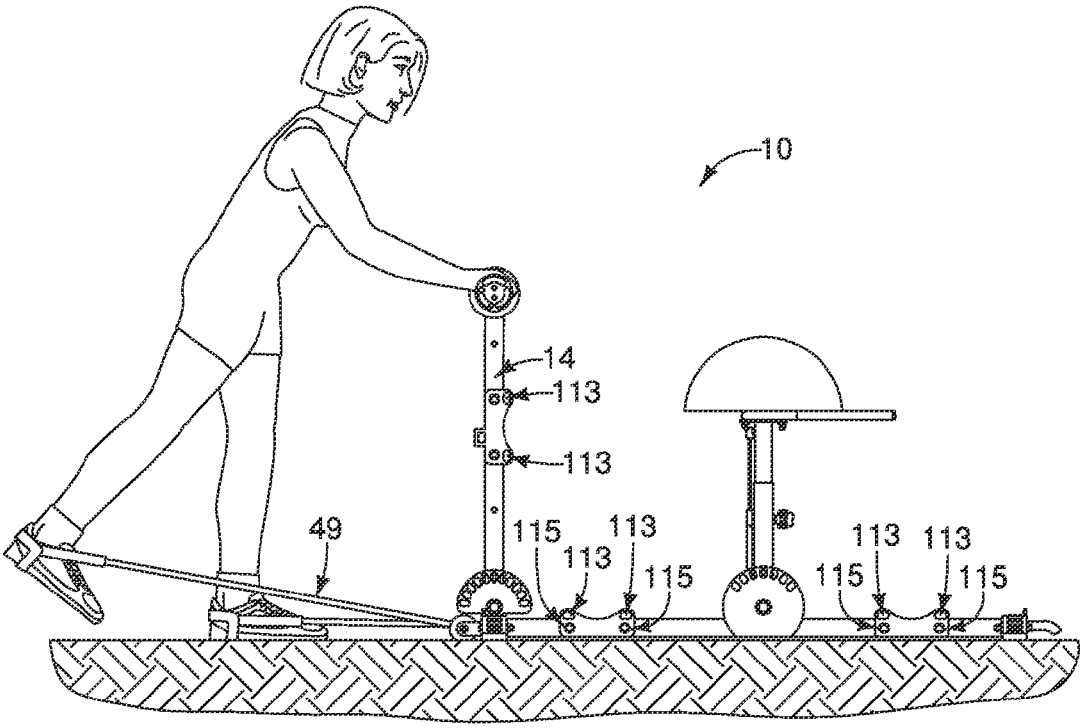
FIG. 13 is a left side planar view of the option embodiment of the versatile glute ham system in use.

In an optional embodiment, a handle 48 is provided at the front end 30 of the stabilization bar 16 as shown in FIG. 1. In the most preferred embodiment, the handle 48 protrudes in a forward direction from the front set of stabilization arms 28. The handle 48 may be secured to the front set of stabilization arms 28 by welding, glue, molding or mechanically bolting the handle 48 to the front set of stabilization arms 28. In the most preferred embodiment, the handle 48 is bolted onto the front set of stabilization arms 28. The handle 48 can also be used to attach a rubber tubes with grips or resistance bands 49 for additional exercise options as shown in FIG. 11.

Now referring to FIGS. 3, 4 and 5, the pivoting center pad assembly 12 is provided with a right center pad 50 and a left center pad 52 or optionally as one solid center pad 54 (since the preferred embodiment uses a right center pad 50 and a left center pad 53, the center pads will be collectively referred to as the center pad 55; however, it will be appreciated that one solid center pad 54 may be used). The center pad 55 is effectively the cushion or cushions to assist the user in doing exercises and provide comfort. The shape of the right center pad 50 and the left center pad 52 are semicircles with the arched portion facing in an upward direction. When one solid center pad 54 is used, the preferred shape is still that of a semicircle.

Now referring to FIG. 3, just below the center pad 55 is a wide A-shaped support bar 56. The wide A-shaped support bar 56 resides planarly and parallel to a bottom surface 58 of the right center pad 50 and the left center pad 52 to provide support and stability to the center pad 55. The right center pad 50 and the left center pad 52 are connected to the wide A-shaped support bar 56 by either screws, straps or an adhesion means. A set of bottom ends 58 extend in a forward direction from the wide A-shaped support bar 56. The set of bottom ends 58 serve as support grips when the user lays over the center pads 55.

Now referring to FIGS. 3, 8, 9 and 10, a height adjuster 60 is found beneath the wide A-shaped support bar 56 to adjust the height of the center pad 55 from an up position 62 as shown in FIG. 9 to a down position 64 as shown in FIG. 10. The height adjuster 60 contains a male section 66 provided with a plurality of height holes 68 and a female section 70 that receives the male section 66. A height locking pin 72 is provided on the female section 70 and is insertable into a corresponding height hole 68 that is desired by the user. The height locking pin 72 may be disengaged by pulling on the height locking pin 72 and the center pads 55 may be adjusted up or down and secured into its new position by releasing the height locking pin 72 and securing the height locking pin 72 into the new corresponding height hole 68. The height locking pin 72 may be a spring loaded pin, a simple cylindrical pin or a screw. To add additional firmness to the pivoting center pad assembly 12, a fixing knob 74 is provided on the female section 70 that contains a tethered extension that presses into the side or edge of the male section 66 to prevent wobbles or movement of the male section 66. This action is performed by rotating the fixing knob 74 that tightens or loosens the tethered extension to the male section 66 and behaves like a screw. To add to the ease of adjusting the height of the male section 66, a shock 76 may optionally be employed to absorb the abrupt rising and falling of the center pad 55 to avoid injury to the user.

Now referring to FIGS. 3, 4, 9 and 10, the pivoting center pad assembly 12 is designed to pivot 180 degrees relative to the stabilization bar 16 by the means of the center pad connection assembly 18. The center pad connection assembly 18 is provided with a center pad locking plate 78 fixed to the stabilization bar 16. The center pad locking plate 78 is most preferably in the shape of a semicircle but may be of any suitable shape such as a square, rectangle, or half of a hexagon just to serve as an example. A flat side 80 of the center pad locking plate 78 is affixed to the stabilization bar 16 and the corresponding female section 70 of the pivoting center pad assembly 12 extends outwardly from stabilization bar 16. The means of affixing may be provided by welding, securing mechanically with a nut and bolt assembly, adhering with an adhesive or other well know means in the art. A peripheral side 82 of the center pad locking plate 78, such as the circular portion in the preferred embodiment, is provided with a plurality of pivoting center pad locking holes 84. The plurality of pivoting center pad locking holes 84 correspond with a pivoting center pad locking pin 86 that is secured to the female section 70 of the height adjuster 60. The pivoting center pad locking pin 86 is designed to be inserted with ease into any of the plurality of pivoting center pad locking holes 84. The pivoting center pad locking pin 86 is most preferably a spring loaded pin that springs into the corresponding pivoting center pad locking hole 84 after manually pulling back and releasing the pivoting center pad locking pin 86. Other types of pivoting center pad locking pins 86 may optionally be used such as a screw type pin, sliding pin, or others well known in the art. The female section 70 of the pivoting center pad assembly 12 is supported on the stabilization bar 16 by adhering rotatably at a lower segment 88 of the female section 70. The pivoting center pad assembly 12 can thus be rotated from approximately 0 degrees (a back position as shown in FIG. 3) to approximately 180 degrees (a forward position as shown in FIG. 4) and locked into place with the use of the pivoting center pad locking pin 86. While in operation, the pivoting center pad assembly 12 is usually in the 90 degree position; however, tension or extra resistance can be achieved for various exercises by adjusting the pivoting center pad assembly 12 closer to 0 degrees or closer to 180 degrees depending on the exercise being performed.

Now referring to FIGS. 1, 3, 4 and 7, the pivoting resistance arm assembly 14 is provided with a set of ankle pads 90 that wrap around a pair of resistance arms 92. The pair of resistance arms 92 extend outwardly from a top portion 94 of the resistance arm assembly 14. The set of ankle pads 90 are round and are made of a cushion like material for comfort when doing exercises. However, unlike traditional glute ham machines, the present versatile glute ham system 10 is provided with push-up handles 96. In the preferred embodiment, the push-up handles 96 are created by not extending the set of ankle pads 90 down the entire length of the pair of resistance arms 92. There is sufficiently exposed resistance arm 92 that will be referred to as the naked portion of the resistance arm to accommodate the grip of a large hand comfortably. As the name implies, the push-up handles 96 enable the user to grip the push-up handles 96 to do push-ups. Furthermore, the push-up handles 96 may be optionally provided with engraved or adhered grips (not shown) to assist the user to grip the push-up handles 96 more firmly. At a far end of the push-up handles 96, a plurality of push-up handle connectors 98 are provided. The push-up handle connectors 98 are preferably a divided circular protrusion or attachment that is designed to receive rubber tubes with grips. The push-up handle connectors 98 are preferably made of the same material as the push-up handles 96 but may also be constructed of a durable metal such as steel, a firm plastic substance or other appropriate material.

Now referring to FIGS. 3, 4, 9 and 10, the pivoting resistance arm assembly 14 is designed to pivot 180 degrees relative to the stabilization bar 16 by the means of the resistance arm connection assembly 100. The resistance arm connection assembly 100 is provided with a resistance arm locking plate 102 fixed to the stabilization bar. The resistance arm locking plate 102 is most preferably in the shape of a semicircle but may be of any suitable shape such as a square, rectangle, or half of a hexagon. A flat side 80 of the resistance arm locking plate 102 is affixed to the stabilization bar 16 and a resistance arm rotation bar 104 extends outwardly from a midpoint of the flat side 80 of the resistance arm locking plate 102. The means of affixing may be provided by welding, securing mechanically with a nut and bolt assembly, adhering with an adhesive or other well-known means in the art. A peripheral side 82 of the resistance arm locking plate 102, such as the circular portion in the preferred embodiment, is provided with a plurality of pivoting resistance arm locking holes 106. The plurality of pivoting resistance arm locking holes 106 correspond with a pivoting resistance arm locking pin 108 that is secured to the pivoting resistance arm assembly 14. The pivoting resistance arm locking pin 108 is designed to be inserted with ease into any of the plurality of pivoting resistance arm locking holes 106. The pivoting resistance arm locking pin 108 is most preferably a spring loaded pin that springs into the corresponding pivoting resistance arm locking hole 106 after manually pulling back and releasing the pivoting resistance arm locking pin 108. Other types of pivoting resistance arm locking pins 108 may optionally be used such as a screw type pin, sliding pin, or others well known in the art. The resistance arm rotation bar 104 supports the pivoting resistance arm assembly 14 by adhering rotatably in a lower segment 110 of the pivoting resistance arm assembly 14. The pivoting resistance arm assembly 14 can thus be rotated from approximately 0 degrees to approximately 180 degrees and locked into place with the use of the pivoting resistance arm locking pin 108. While in operation, the pivoting resistance arm assembly 14 is usually in the 90 degree position; however, tension or extra resistance can be achieved for various exercises by adjusting the pivoting resistance arm assembly 14 closer to 0 degrees (a back position as shown in FIG. 3) or closer to 180 degrees (a forward position as shown in FIG. 4) depending on the exercise being performed.

Now referring to FIGS. 5, 8, 11, 12 and 13, an important feature of the present versatile glute ham system 10 is the availability of connector points 112 to accommodate rubber tubes with grips or resistance bands 49. The connector points 112 are preferably connector apertures 113 where rubber tubes or resistance bands 49 may be tied to or clipped into. The connector apertures 113 are preferably round but can be of any shape that might accommodate the rubber tubes with grips or resistance bands 49. The connector apertures may be punched out of the stabilization bar 16, the plurality of stabilization arms 26 and the pivoting resistance arm assembly 14 of the versatile glute ham system 10; however, in the preferred embodiment, the connector apertures 113 are punched into connector plates 114 and secured to a multitude of points throughout the versatile glute ham system 10.

An illustration of the multitude of points can be found in FIGS. 5, 8, 11, 12 and 13 where the placement is optimized to support the maximum versatility in exercise options and resistance points. The connector plates 114 are preferably similar in size and shape to make the connector plates 114 easy to manufacture and assemble. The connector plates 114 may be welded, adhered or bolted to the stabilization bar, the plurality of stabilization arms 26 and the pivoting resistance arm assembly 14 of the versatile glute ham system 10. Preferably, two connector apertures 113 and two securement holes 115 are provided on the connector plates 114. The securement holes 115 are designed to receive a nut and bolt for assembly and disassembly. The two connector apertures 113 are found on extending arches 116 of the connector plates so that the connector apertures 113 might be found on an extended portion that protrudes away from the stabilization bar 16, the plurality of stabilization arms 26 and the pivoting resistance arm assembly 14. In this manner, the rubber tubes with grips or just resistance bands 49 can easily be secured to the connector plates 114. Also with this design, the connector plates 114 may be turned in an opposite direction. This becomes particularly useful on the pivoting resistance arm assembly 14 because having the option of having a connector plate 114 that faces towards the pivoting center pad assembly 12 and can add stability to the versatile glute ham system 10 depending on the exercise desired by the user. Furthermore, if the connector plate 114 can easily be replaced in the event that the connector plate 114 becomes damaged or broken.

While a particular embodiment of the versatile glute ham system 10 has been described herein, it will be appreciated by those skilled in the art that changes and modifications may be made thereto without departing from the invention in its broader aspects and as set forth herein.

The invention claimed is:

1. A versatile glute ham system for use with resistance bands, the versatile glute ham system comprising:

a pivoting resistance arm assembly pivotally connected to a stabilization bar, wherein said pivoting resistance arm assembly is provided with a resistance arm connection assembly to secure said pivoting resistance arm assembly to a fixed position relative to said stabilization bar;

a pivoting center pad assembly, wherein said pivoting center pad assembly is in operational relationship to said pivoting resistance arm assembly and is pivotally connected to said stabilization bar, wherein said pivoting center pad assembly is provided with a center pad connection assembly with a semi-circle center pad locking plate fixed to said stabilization bar to secure said pivoting center pad assembly to a fixed position relative to said stabilization bar and wherein said pivoting center pad assembly further comprising a center pad in the shape of a semicircle;

a plurality of connector points on said pivoting resistance arm assembly and said stabilization bar to receive resistance bands; and a pair of push-up handles located on said pivoting resistance arm assembly.

2. The versatile glute ham system of claim 1, wherein said resistance arm connection assembly is provided with a resistance arm locking plate fixed to said stabilization bar.

3. The versatile glute ham system of claim 2, wherein a resistance arm rotation bar extends outwardly from a midpoint of a flat side of said resistance arm locking plate.

4. The versatile glute ham system of claim 3, wherein said resistance arm rotation bar is rotatable from about 0 degrees to about 180 degrees relative to said stabilization bar.

5. The versatile glute ham system of claim 1, wherein said pair of push-up handles is operationally located near a set of ankle pads that reside on a top portion of said resistance arm assembly.

6. The versatile glute ham system of claim 1, wherein said pair of push-up handles are provided with a plurality of push-up handle connectors at a far end of said push-up handles.

7. The versatile glute ham system of claim 1, wherein a center pad rotation bar extends outwardly from a midpoint of a flat side of said semi-circle center pad locking plate.

8. The versatile glute ham system of claim 7, wherein said center pad rotation bar is rotatable from about 0 degrees to about 180 degrees relative to said stabilization bar.

9. The versatile glute ham system of claim 1, wherein a height adjuster is found beneath said center pad to move said center pad from an up position to a down position.

10. The versatile glute ham system of claim 9, wherein the height adjuster contains a male section provided with a plurality of height holes and a female section that receives said male section.

11. The versatile glute ham system of claim 10, further comprising a shock beneath said center pad and operationally related to said male section and female section of said height adjuster.

12. The versatile glute ham system of claim 1, wherein said plurality of connector points are located on connector plates.

13. The versatile glute barn system of claim 12, wherein said connector plates are provided with extending arches to accommodate at least one connector aperture.

14. A versatile glute ham system for use with resistance bands, the versatile glute ham system comprising:

a pivoting resistance arm assembly and a pivoting center pad assembly are pivotally connected to a stabilization bar and are pivotally rotatable from about 0 degrees to about 180 degrees relative to said stabilization bar, wherein said pivoting resistance arm assembly is provided with a resistance arm locking plate fixed to said stabilization bar to secure said pivoting resistance arm assembly to a fixed position relative to said stabilization bar and said pivoting center pad assembly is provided with a semi-circle center pad locking plate fixed to said stabilization bar to secure said pivoting center pad assembly to a fixed position relative to said stabilization bar, and a plurality of connector points on said pivoting resistance arm assembly, said stabilization bar and a plurality of stabilization arms in proximal relationship to said stabilization bar to receive resistance bands.

15. The versatile glute ham system of claim 14, further comprising a pair of push-up handles located on said pivoting resistance arm assembly.

16. The versatile glute ham system of claim 15, wherein said pair of push-up handles are provided with a plurality of push-up handle connectors at a far end of said push-up handles.

17. The versatile glute ham system of claim 16, wherein said pair of push-up handles are provided with grips.

* * * * *